US006414638B1

(12) United States Patent
Egashira

(10) Patent No.: US 6,414,638 B1
(45) **Date of Patent: *Jul. 2, 2002**

(54) ANTENNA FOR RADIO TELEPHONE

(75) Inventor: Yoshimi Egashira, Kanagawa-ken (JP)

(73) Assignee: Houkou Electric Corporation, Kanagawa-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/360,657

(22) Filed: Jul. 26, 1999

Related U.S. Application Data

(63) Continuation-in-part of application No. 09/257,176, filed on Feb. 25, 1999, now abandoned.

(30) Foreign Application Priority Data

Jul. 27, 1998 (JP) ..... 10-211534
Jul. 7, 1999 (JP) ..... 11-192906

(51) Int. Cl.[7] ..... H01Q 1/24
(52) U.S. Cl. ..... 343/702; 343/895
(58) Field of Search ..... 343/702, 900, 343/895; H01Q 1/24

(56) References Cited

U.S. PATENT DOCUMENTS

| | | | |
|---|---|---|---|
| 4,868,576 A | 9/1989 | Johnson | 343/702 |
| 5,504,494 A | 4/1996 | Chatzipetros et al. | |
| 5,612,704 A | 3/1997 | Cole | |
| 5,812,093 A | 9/1998 | Thompson et al. | |

FOREIGN PATENT DOCUMENTS

| | | |
|---|---|---|
| JP | 06-252619 | 9/1994 |
| JP | 7-212117 | 8/1995 |
| JP | 7-288412 | 10/1995 |
| JP | 8-23216 | 1/1996 |
| JP | 08-116206 | 5/1996 |
| JP | 9-8525 | 1/1997 |
| JP | 09-172312 | 6/1997 |
| JP | 09-246828 | 9/1997 |
| JP | 10-150310 | 6/1998 |

*Primary Examiner*—Michael C. Wimer
(74) *Attorney, Agent, or Firm*—Nixon Peabody LLP; Donald R. Studebaker

(57) ABSTRACT

Provides an antenna for a radio telephone whereby, in a state wherein the rod-shaped antenna is extended to outside the case of the radio telephone, the effects of the human body are negligible and emission of radio waves at an angle close to the horizontal direction is possible, and in a state wherein the rod-shaped antenna is retracted within the case, no unwanted radiation is produced. For this purpose, a helical antenna 20 having an electrical length of $\lambda/4$ and a rod-shaped antenna 10 extendable and retractable with respect to the case through the hollow central portion of the helical antenna 20 and having an electrical length of about $3\lambda/8$ and inductive reactance are electrically coupled by means of an electrostatic coupling portion 30 having capacitive reactance such that, in the state wherein the rod-shaped antenna 10 is extended from the case 50, the inductive reactance of the rod-shaped antenna 10 is cancelled out. The length of the bottom portion 12*a* of the connecting member 12 is set to a length such that when the rod-shaped antenna 10 is retracted within the case 50, the bottom portion 12*a* of the connecting member 12 passes through the helical coil 12 over the entire length thereof, severing electrical coupling between the helical antenna 20 and the rod-shaped antenna 10.

9 Claims, 12 Drawing Sheets

MARKER 1: 1.1841
1.9 GHz
2: 1.4211
2 GHz
3: 1.2246
2.1 GHz
4: 2.2 GHz

FRONT TO BACK PATTERN IN VERTICAL PLANE (Z-X PLANE)

| | |
|---|---|
| MEASURED FREQUENCY | 1900 MHz |
| STANDARD ANTENNA LEVEL | -57.3 dBm |
| ANTENNA GAIN | -0.1 dBd |
| AVERAGE GAIN | -4.4 dB |

FRONT TO BACK PATTERN IN VERTICAL PLANE (Z-X PLANE)

| | |
|---|---|
| MEASURED FREQUENCY | 2200 MHz |
| STANDARD ANTENNA LEVEL | -57.8 dBm |
| ANTENNA GAIN | 1.3 dBd |
| AVERAGE GAIN | -4.4 dB |

MEASURED FREQUENCY 1900 MHz
STANDARD ANTENNA LEVEL -57.3 dBm
ANTENNA GAIN 0.9 dBd
AVERAGE GAIN -3.6 dB

MEASURED FREQUENCY 2200 MHz
STANDARD ANTENNA LEVEL -57.8 dBm
ANTENNA GAIN 1.5 dBd
AVERAGE GAIN -4.5 dB

| | |
|---|---|
| MEASURED FREQUENCY | 1900 MHz |
| STANDARD ANTENNA LEVEL | -57.3 dBm |
| ANTENNA GAIN | 0.0 dBd |
| AVERAGE GAIN | -2.5 dB |

| | |
|---|---|
| MEASURED FREQUENCY | 2200 MHz |
| STANDARD ANTENNA LEVEL | -57.8 dBm |
| ANTENNA GAIN | -1.2 dBd |
| AVERAGE GAIN | -2.0 dB |

ANTENNA FOR RADIO TELEPHONE

This application is a continuation-in-part of U.S. Ser. No. 09/257,176, filed Feb. 25, 1999 now abandoned.

BACKGROUND OF THE INVENTION

1. Field of the Invention

The present invention relates to an antenna for a radio telephone, and more particularly to an antenna for a radio telephone for use in a cellular, PHS (Personal Handy Phone System), or other mobile phone system.

2. Description of the Related Art

Today, cellular, PHS, and other mobile phone systems enjoy widespread use. The radio telephones (telephones) used in such systems have in recent years become increasingly more compact and lightweight, creating a need to make the antennas used therefor smaller in association with the smaller size and lighter weight of the radio telephones.

An extendible/retractable antenna used by extending a rod-shaped antenna from the case of the radio telephone to communicate in locations where electric field strength is weak, and retracting the rod-shaped antenna into the case of the radio telephone to make it convenient to hold and walk when being carried about, and that stands by to receive calls with a helical antenna alone is commonly known as a conventional radio telephone antenna of this type.

For example, there is known an antenna of the kind depicted in FIG. 11, wherein a conductor 71 constituting the main body of a rod-shaped antenna 70 is provided at the distal end thereof via an insulating connecting member 72 and a conducting connector 82 with a helical coil 81 constituting the main body of a helical antenna 80 (hereinafter termed "antenna of Conventional Art Example 1"). Where $\lambda$ represents the wavelength of the service frequency, the electrical length of the rod-shaped antenna 70 is established in the vicinity of $\lambda/4$ and the electrical length of the helical antenna 80 is established at $\lambda/4$. When the antenna of Conventional Art Example 1 is extended from the case 50 of the radio telephone (FIG. 11*a*), a high-frequency electric current from a power supply point 41 provided to the circuit board 40 of the radio telephone is supplied through a connecting lead 42 and via a metal retaining member 91 and a fastener 92 so as to excite the antenna 70. The helical coil 81 provided to the distal end of the conductor 71 is insulated by means of the connecting member 72, so the high-frequency electric current supplied by the power supply point 41 is obstructed by the connecting member 72 and does not excite the helical antenna 80. That is, in the state of the antenna being extended from the case 50, radio waves are emitted from the rod-shaped antenna 70 exclusively, and radio waves are not emitted from the helical antenna 80.

Meanwhile, when the rod-shaped antenna 70 is retracted within the case 50 (FIG. 11*b*), high-frequency electric current supplied by the power supply point 41 of the radio telephone through the connecting lead 42 and via the conducting connector 82 excites the helical antenna 80. The rod-shaped antenna 70 retracted within the case 50 is not excited since the high-frequency electric current is obstructed by the connecting member 72.

That is, as shown in FIG. 12 the antenna of Conventional Art Example 1 is such that when the rod-shaped antenna 70 is extended from the case 50 for use, sending and reception are carried out exclusively by the rod-shaped antenna 70 of electrical length in the proximity of $\lambda/4$, and where the rod-shaped antenna 70 is retracted within the case 50 for use, sending and reception are carried out exclusively by the helical antenna 80 of electrical length of $\lambda/4$.

Also known is an antenna like that depicted in FIG. 12, wherein a helical coil 81 is arranged at the distal end of a conductor 11 via a conducting connector 73 only (hereinafter termed "antenna of Conventional Art Example 2"). A rod-shaped antenna 74 comprises a conductor 71 and a connector 73, the electrical length thereof being established at $\lambda/2$, including the conductor 71 and the connector 73. The electrical length of a helical antenna 80 comprising a helical coil 81 is established at $\lambda/4$.

The conductor 71 and the helical coil 81 are electrically connected by means of the connector 73, and thus when the antenna of Conventional Art Example 2 is in a state extended from the case 50 (FIG. 12*a*), high-frequency electric current from a power supply point 41 supplied through a connecting lead 42 and via a metal retaining member 91 and a fastener 92 excites the rod-shaped antenna 74 as well as exciting the helical antenna 80. The electrical length of the rod-shaped antenna 74 is $\lambda/2$ and the electrical length of the helical antenna 80 is $\lambda/4$, so in a state with the rod-shaped antenna 74 extended from the case 50, the total electrical length of the rod-shaped antenna 74 and the helical antenna 80 is $3\lambda/4$.

Meanwhile, in a state with this antenna retracted within the case 50 (FIG. 12*b*), high-frequency electric current from the power supply point 41 of the radio telephone supplied through the connecting lead 42 and via the connector 73 excites not only the helical antenna 80 but also the rod-shaped antenna 74 retracted within the case 50.

That is, this antenna of Conventional Art Example 2 is such that, in the event that the rod-shaped antenna 72 is extended from the case 50, the rod-shaped antenna 3 of electrical length of $\lambda/2$ and the helical antenna 4 of electrical length of $\lambda/4$ are simultaneously excited to carry out sending and reception as an antenna of electrical length of $3\lambda/4$, and in the event of use with the rod-shaped antenna 74 retracted within the case 50, sending and reception are carried out through parallel operation of the rod-shaped antenna 74 of electrical length of $\lambda/2$ and the helical antenna 80 of electrical length of $\lambda/4$.

As is well known, emission within a vertical plane by a rod-shaped antenna of electrical length of $\lambda/4$ is directed downward with respect to the horizontal direction,. which is a cause of lowered sensitivity in the horizontal direction. Accordingly, the antenna of Conventional Art Example 1 having a rod-shaped antenna 70 of electrical length of $\lambda/4$ has this problem of lowered sensitivity. Since the rod-shaped antenna 70 is a grounded type antenna, when the radio telephone is used by pressing against the ear, there is the problem of the impedance characteristic, etc., fluctuating due to the effects of the human body.

Further, in the antenna of Conventional Art Example 1, in the state with the rod-shaped antenna 70 extended from the case 50, the helical antenna 80 functions merely as a grip for extending and retracting the rod-shaped antenna 70 with respect to the case 50, and efficiency is poor given the size of the antenna.

Since it is common to manufacture the conductor 71 using a member of small diameter having good elasticity, the arrangement of a helical coil 81 having large mass at the distal end thereof creates susceptibility to vibration due to external pressure, the amplitude thereof being large, creating susceptibility to mechanical or electrical noise and posing the risk that the retaining power of the retaining member 91 may deteriorate.

Further, the connecting member 72 of this antenna of Conventional Art Example 1 has a problem in terms of flexural strength, and depending on the length thereof breakage may occur with repeated flexing. Improving the flexural durability requires means such as lengthening the length, etc., but by so doing the total length of the rod-shaped antenna 70 will become physically long, creating the problem of not being retractable into the case at the time of retraction.

Meanwhile, as is well known, emission within a vertical plane by an antenna of electrical length of $3\lambda/4$ is split into two directions with respect to the horizontal direction, with the main emission being upward-directed, and remains slightly in the horizontal direction as sub-emission. Accordingly, in the antenna of Conventional Art Example 2, wherein transmission and reception are carried out as an antenna of electrical length of $3\lambda/4$ when the rod-shaped antenna 74 is extended, in the state with the rod-shaped antenna 74 extended from the case 50, there will be as a result the problem of lowered sensitivity in the aforementioned horizontal direction. This antenna of Conventional Art Example 2 is a grounded type antenna as is the antenna of Conventional Art Example 1, and thus when the radio telephone is used by pressing against the ear, there is the problem of the impedance characteristic, etc., fluctuating due to the effects of the human body.

Further, the length of the antenna of Conventional Art Example 2 is close to twice the length of the antenna of Conventional Art Example 1, and, as in Conventional Art Example 1, it is common to manufacture the conductor 11 using a member of small diameter having good elasticity; further, a helical coil 81 having virtually the same weight as in Conventional Art Example 1 is provided at the distal end thereof, creating susceptibility to vibration due to external pressure, the amplitude thereof being large, creating susceptibility to mechanical or electrical noise and posing the risk that the retaining power of the retaining piece may deteriorate. Further, the antenna of Conventional Art Example 2 has the problem that the electrical length of the rod-shaped antenna 74 is long when retracted, so that it cannot be physically accommodated within the increasingly more compact cases of recent years.

Further, when the rod-shaped antenna 74 is retracted within the case 50, not only the helical antenna 80 but also the rod-shaped antenna 74 retracted within the case 50 are excited, with the result that radio waves can be emitted within the case 50 as well. When used in a location with strong reception or electric field strength, for example, unwanted radio waves are emitted from the rod-shaped antenna 74 with the case (hereinafter termed "unwanted radiation"), causing interference, etc., and posing the problem of adverse effects on the electric circuits within the case 50. To prevent this, there is required special means such as electromagnetically shielding the portion housing the rod-shaped antenna 74. However, this runs counter to the trend of compactness and lighter weight on the part of radio telephones.

As a way to resolve the problems pertaining to the antennas of Conventional Art Examples 1 and 2, and particularly the problem of electrical length with the rod-shaped antenna extended from the case and of unwanted radiation with it retracted within the case, there has been proposed an antenna wherein the electrical length of the rod-shaped antenna is set to $3\lambda/8$ and the electrical length of the helical antenna to $\lambda/4$, and designed such that when the rod-shaped antenna is extended to the outside of the case, the basal end of the conductor and the basal end of the helical coil are connected in common to a power supply portion and co-operate, and when the rod-shaped antenna is retracted within the case, only the helical antenna is connected to the power supply portion (see Japanese Unexamined Patent Publication No. 8(1996)-23216; hereinafter "Conventional Art Example 3").

However, the antenna of Conventional Art Example 3 has the problem of being impossible to realize in terms of antenna engineering. Specifically, it is stated that, "when the rod-shaped antenna element is extended to the outside of the case, the basal end of the rod-shaped antenna element (conductor) and the basal end of the helical antenna element (helical coil) are connected in common to a power supply portion. Thus, the two antennas co-operate". However, the impedance of the helical antenna of electrical length of $\lambda/4$ is nominally $Z=R\pm j\mathbf{0}$, and the impedance of the other rod-shaped antenna of electrical length of $3\lambda/8$ is $Z=R+jX$, and thus where the two antennas are connected at the basal ends thereof and the two antennas are postulated to be R=50 ?, the composite impedance is $Z_r=50/2+jX=25+jX$. Further, since the means for canceling out the inductive reactance+jX of the rod-shaped antenna is unclear, base impedance of $Z=50\pm j\mathbf{0}$ on the part of the antenna cannot be realized, and thus the antenna is not realizable.

As shown in FIGS. 11 and 12, in the antenna of either Conventional Art Example 1 or 2 the metal retaining member 91 etc. is arranged in proximity to the power supply portion 41, thus creating between the retaining member 91 and the power supply portion 41 a large free electrostatic capacitance that cannot be ignored in terms of antenna engineering, and resulting in impaired impedance matching. Specifically, in light of the wide service frequency band assigned to portable radio telephones these days, adapting to wider bandwidth through impedance matching means that creation of the aforementioned free electrostatic capacitance will make it difficult to adapt to the wider bandwidth. Another problem associated with creation of free electrostatic capacitance is lowered gain and sensitivity.

Further, in the event that the radio telephone should be accidentally dropped on the floor in a state with the rod-shaped antenna retracted within the case 50, a concentrated impact load will be applied to the base of the helical antenna 80, creating the risk that the helical antenna 80 will break. In the event that such an accident should happen, it will be necessary to change and replace the antenna portion. In such an event, it will be necessary to remove the retaining member 91 from the case 50 and replace both the rod-shaped antenna and the helical antenna, so the expense associated with repair is quite high.

Accordingly, while various means have been devised for resolving the problems pertaining to Conventional Art Examples 1–3, these means generally include elements that run counter to a more compact and lightweight radio telephone.

SUMMARY OF THE INVENTION

The present invention was developed with the foregoing in view, and is intended to provide an antenna for a radio telephone that, under the limitations imposed by more compact size and lighter weight of a radio telephone, and particularly the condition that the rod-shaped antenna must be of a length readily accommodated within the case, experiences negligible effect by the human body when the rod-shaped antenna extended to the outside of the case for use, and that ensures an electrical length sufficient for emission of radio waves at an angle close to the horizontal direction.

It is a further object of the present invention to provide an antenna for a radio telephone such that, when used with the rod-shaped antenna retracted within the case, the rod-shaped antenna does not produce any unwanted radiation.

It is a still further object of the present invention to eliminate any metal component from the vicinity of the power supply portion of the radio telephone, thereby realizing good impedance characteristics such that free electrostatic capacitance created through the agency of metal components can be ignored in terms of antenna engineering, and this affords improvement in the reduced gain and sensitivity resulting from free electrostatic capacitance.

It is yet a further object of the present invention to provide an antenna for a radio telephone adaptable to greater bandwidth on the part of the service frequency band of a radio telephone.

It is yet a further object of the present invention to provide an antenna for a radio telephone that, in terms of mechanical strength, will not in the course of service, be subject to localized concentrated stresses such that breakage results, and that, in the event that breakage does occur, will entail reduced repair costs.

A first antenna for a radio telephone which pertains to the present invention comprises a helical antenna having an electrical length of $\lambda/4$ (where $\lambda$ is the wavelength of the service frequency) and having the basal end thereof, which is arranged on the wall of the case of the radio telephone, connected to the power supply component of the radio telephone, and a rod-shaped antenna extendable and retractable with respect to the case of the radio telephone through the hollow central portion of the helical antenna, with electrical length of about $3\lambda/8$ and having inductive reactance. This antenna is characterized in that when the rod-shaped antenna is extended from the radio telephone case, the basal end of the rod-shaped antenna and the distal end of the helical antenna are electrically coupled by means of an electrostatic coupling portion having capacitive reactance that cancels out the inductive reactance.

Here, "arranged on the wall of the case of the radio telephone" is used to mean arranged on the wall of the case such that the rod-shaped antenna is extendable and retractable with respect to the case of the radio telephone through the hollow central portion of the helical antenna. Any location in proximity to the wall is acceptable provided that it is not in proximity to the center of the case interior of the radio telephone, for example, a projecting portion may be provided to the case, and [the antenna] installed on this projecting portion.

In preferred practice, the electrostatic coupling portion of the antenna for the first and second radio telephone will constitute a mechanical structure. Here, "constitute a mechanical structure" is used to mean that, without using any electrical component such as a so-called capacitor, electrostatic coupling is effected, for example, by arranging metal plates in opposition at close proximity, or otherwise effecting electrostatic coupling through arrangement of the basal end of the rod-shaped antenna and the distal end of the helical antenna in close proximity to each other.

In preferred practice, the antenna for a radio telephone which pertains to the present invention will be provided with an insulating grip for extending and retracting the rod-shaped antenna with respect to the case, and an insulating connecting member for connecting the grip and the rod-shaped antenna, these being integrally formed through insert molding at the distal end of the rod-shaped antenna.

Here, "distal end of the rod-shaped antenna" is used to mean that end of the rod-shaped antenna that projects to the outside of the case, and does not mean the end located within the case.

Here, in preferred practice, the length of the connecting member is set to a length such that when the rod-shaped antenna is retracted within the case, the connecting member passes through the helical antenna over the entire length thereof, severing electrical coupling between the helical antenna and the rod-shaped antenna.

In preferred practice, the antenna for the first radio telephone which pertains to the present invention is characterized in that the distance between the power supply portion and the metal retaining member for retaining the rod-shaped antenna is of such a size that the free electrostatic capacitance created between the two is essentially zero.

A second radio device antenna according to the present invention is a radio device antenna of a type that is indifferent to whether or not the rod-shaped antenna freely retracts into or extends from the case of the radio device through the hollow core of a helical antenna. What is characteristic of this second radio device antenna is that it comprises a helical antenna of electrical length $\lambda/4$, deployed in a wall of the case of the radio device, the basal end whereof is connected to the power supply of the radio device, and a rod-shaped antenna having an electrical length of $3\lambda/8$ and exhibiting inductive reactance, configured such that, when the rod-shaped antenna is being used, the helical antenna and the rod-shaped antenna are electrically coupled in an electrostatic coupling having a capacitive reactance with which the inductive reactance is cancelled out, with a gap between the basal end of the rod-shaped antenna and the distal end of the helical antenna.

In this second radio device antenna, it is preferable that the rod-shaped antenna is capable of being freely raised or lowered, to a deployed position projecting from the radio device case when in use, and to a non-deployed position folded along part of the case when not in use.

By "along part of the case" here is meant "along any one surface of the case of the radio device, external thereto." When the rod-shaped antenna is in the non-deployed position, it is preferable that power to that rod-shaped antenna be interrupted. It is not absolutely necessary that the power be cut to this rod-shaped antenna, however, and the rod-shaped antenna and helical antenna may operate together with the rod-shaped antenna folded over along part of the case.

Here, "free electrostatic capacitance of essentially zero" does not mean that the size of the free electrostatic capacitance is itself essentially zero, but rather that the size of the free electrostatic capacitance is of a size such that it can be ignored in terms of antenna engineering. The "metal" of the metal retaining member does not signify fabrication from metal exclusively, but also includes fabrication from mixtures of metal with non-metals.

In addition, it is preferable that the antenna for the first and second radio telephone which pertains to the present invention is characterized in that the resonance frequency of the rod-shaped antenna and the resonance frequency of the helical antenna are set so as to provide multiple tuning characteristics.

Here, "having multiple tuning characteristics" is used to means that the resonance frequency of the rod-shaped antenna and the resonance frequency of the helical antenna differ slightly from each other within the service frequency band.

In preferred practice, the antenna for a radio telephone which pertains to the present invention will be provided with a projecting portion situated over a portion of the top face of the case of the radio telephone. The top of the projecting portion will be provided with a retaining portion for retaining the bottom portion of the rod-shaped antenna when the rod-shaped antenna is extended from the case. The helical antenna will be arranged concentrically with respect to the rod-shaped antenna in the space within the projecting portion with a gap between it and the basal end of the rod-shaped antenna.

According to the antenna for the first radio telephone which pertains to the present invention, a helical antenna having electrical length of λ/4 and a rod-shaped antenna of electrical length of about 3λ/8 having inductive reactance are constituted such that when the rod-shaped antenna is withdrawn through the hollow interior of the helical antenna and extended from the case of the radio telephone, the basal end of the rod-shaped antenna and the distal end of the helical antenna are electrically coupled by means of an electrostatic coupling portion having capacitive reactance that cancels out the inductive reactance of the rod-shaped antenna. Therefore, when the rod-shaped antenna is extended from the case for use, the rod-shaped antenna of electrical length of about 3λ/8 and the helical antenna having electrical length of λ/4 co-operate and function integrally as an antenna similar to a ungrounded type, thereby affording an antenna resistant to the effects of the human body and having good efficiency such that radio wave emission characteristics face slightly downward from the horizontal direction in the vertical plane.

The length of the rod-shaped antenna is such that the electrical length is 3λ/8, shorter than λ/2, and thus compared to the antenna of Conventional Art Example 2, the antenna can be accommodated within the case leaving a margin.

Furthermore, with either the first or the second radio device antenna, since the electrostatic coupling portion is formed by a mechanical structure that does not rely on electronic components, the antenna can be produced without the use of electronic components such as capacitors.

By integrally forming a low-mass grip and a connecting member at the distal end of the rod-shaped antenna by means of insert molding, breakage and damage due to flexing of the connecting member are avoided.

By establishing the length of the connecting member connecting the rod-shaped antenna and the helical antenna such that when the rod-shaped antenna is retracted within the case, it passes through the helical antenna over the entire length thereof, severing electrical coupling between the helical antenna and the rod-shaped antenna, power to the rod-shaped antenna can be cut at the instant that the rod-shaped antenna is retracted into the case, thus completely eliminating any unwanted radiation into the interior of the radio telephone.

By setting the distance between the power supply portion and the metal retaining member for retaining the rod-shaped antenna to such a size that the free electrostatic capacitance created between the two is essentially zero, gain and sensitivity can be improved. The impedance characteristics of the antenna are determined by the helical antenna connected to the power supply portion, and since the helical antenna is nominally 50 Ú at electric length of 1/4λ, there is no need to provide a separate matching circuit, etc., for impedance matching, affording an efficient antenna wherein the antenna itself has matched impedance characteristics.

Still further, by setting the resonance frequency of the rod-shaped antenna and the resonance frequency of the helical antenna slightly different so as to produce multiple tuning characteristics, it is possible to produce a multiple tuning antenna wherein the rod-shaped antenna and the helical antenna resonate simultaneously, as a result affording an antenna with good efficiency having a wide service frequency band, i.e., wide band characteristics.

By providing the antenna for a radio telephone which pertains to the present invention with a projecting portion situated over a portion of the top face of the case of the radio telephone, providing the top of the projecting portion with a retaining portion for retaining the bottom portion of the rod-shaped antenna when the rod-shaped antenna is extended from the case, and arranging the helical antenna concentrically with respect to the rod-shaped antenna in the space within the projecting portion with a gap between it and the basal end of the rod-shaped antenna, there is not a large-mass helical antenna located at the distal end of the rod-shaped antenna, so breakage and damage due to flexure of the rod-shaped antenna do not occur. Since this allows a design wherein concentration of impact load at a single point in the event of being mistakenly dropped onto the floor, etc., with the rod-shaped antenna retracted within the case, snapping, breaking, etc., do not readily occur, affording an antenna experiencing few difficulties and having good maintainability. Even if accidentally dropped, since the helical antenna is situated in the space within the projecting portion, in virtually all cases only the rod-shaped antenna will break, and since it will be sufficient simply to repair the rod-shaped antenna, repair costs can be lowered.

A second radio device antenna according to the present invention is configured such that, when the rod-shaped antenna is in use, the helical antenna of electrical length λ/4 and the rod-shaped antenna having an electrical length 3λ/8 and exhibiting reactance are electrically coupled in an electrostatic coupling having a capacitive reactance with which the inductive reactance is cancelled out, with a gap between the basal end of the rod-shaped antenna and the distal end of the helical antenna. Therefore, an efficient antenna can be made with which, as in the first radio device antenna described earlier, when the rod-shaped antenna is in use, the rod-shaped antenna having an electrical length of roughly 3λ/8 and the helical antenna having an electrical length of λ/4 will work cooperatively, functioning integrally almost as an ungrounded antenna, not greatly susceptible to influence by the human body, with the electromagnetic radiation characteristics oriented very slightly below the horizontal plane even in the vertical plane. With this second radio device antenna, moreover, if the rod-shaped antenna is made so that it can be freely raised and lowered between a deployed position projecting from the radio device case during use and a non-deployed position folded against a part of the case when not in use, the rod-shaped antenna can be folded over in the non-deployed position when the radio device is being carried about, thus eliminating the obtrusiveness of the rod-shaped antenna, when on the move, and avoiding the danger of the rod-shaped antenna getting bent and thus damaged or destroyed.

DESCRIPTION OF THE PREFERRED EMBODIMENT

Figure 1:
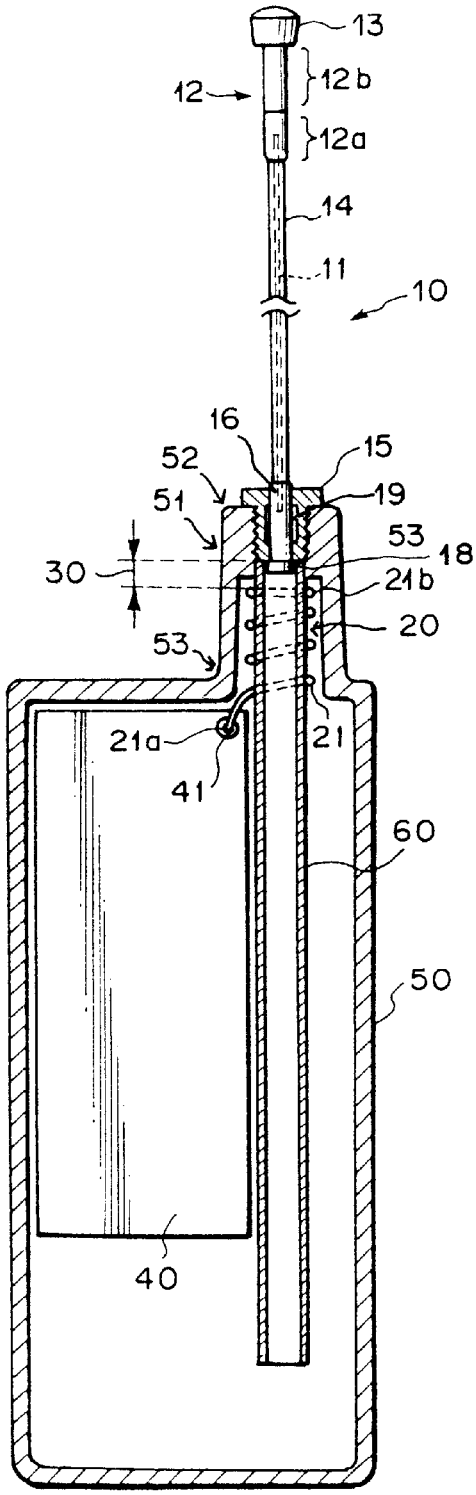
FIG. 1 is a sectional view of radio telephone with the rod-shaped antenna according to an aspect of the present invention extended from the case.
Figure 2:
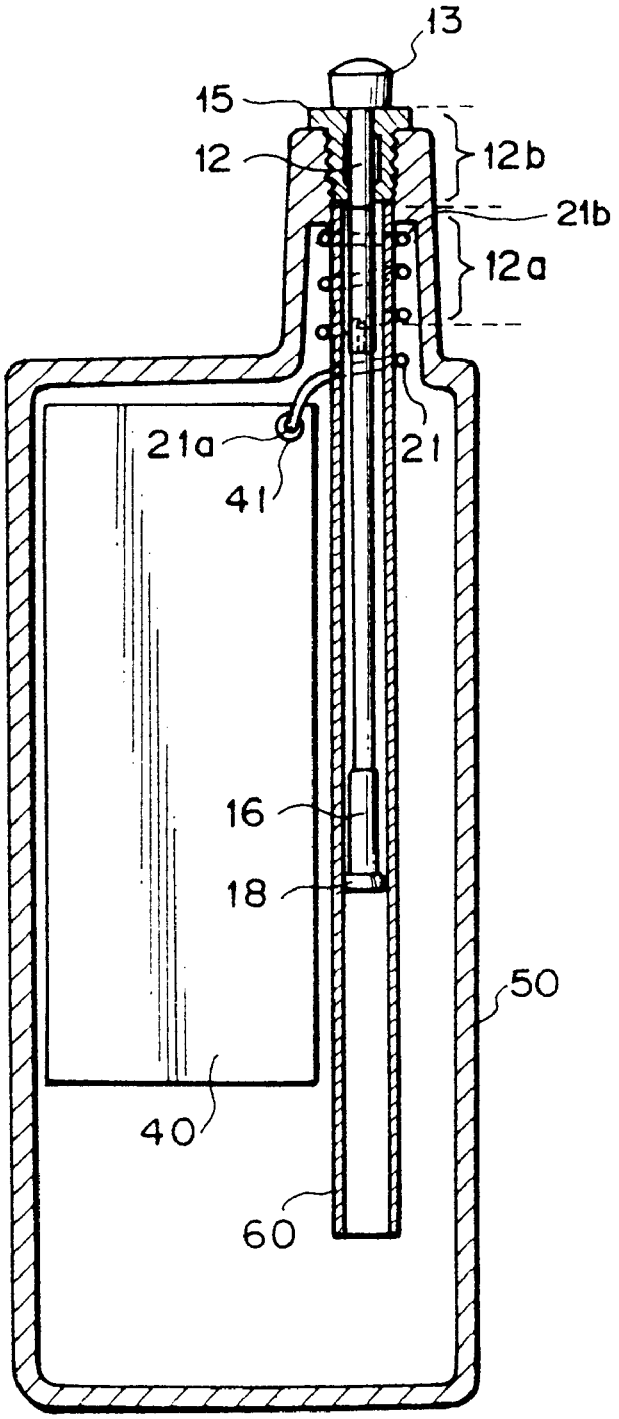
FIG. 2 is a sectional view of radio telephone with the rod-shaped antenna according to an aspect of the present invention retracted within the case.

An aspect of the present invention is described below with reference to the drawings. FIGS. 1 and 2 are sectional views showing the constitution of a radio telephone for use as a portable telephone (hereinafter simply "radio telephone") provided with an antenna for a radio telephone according to an aspect of the present invention. FIG. 1 shows the rod-shaped antenna 10 extended from the case 50, and FIG. 2 shows the rod-shaped antenna 10 retracted within the case 50.

This radio telephone comprises a rod-shaped antenna 10 arranged upright extendably and retractably within the case 50 in the top portion 52 of a projecting portion 51 provided to the top of the case 50, and a helical antenna 20 arranged concentrically with respect to the rod-shaped antenna 10 and within the projecting portion 51 via an electrostatic coupling portion 30. The rod-shaped antenna 10 has electrical length set to about $3\lambda/8$ and has inductive reactance. The helical antenna 20 has electrical length set to $\lambda/4$.

As shown in FIGS. 1 and 2, a projecting portion 51 is provided on the top wall of the case 50 of the radio telephone, and a helical coil 21 constituting the principal element of the helical antenna 20 is arranged in the space within the projecting portion 51. In preferred practice, the projecting portion 51 is integrally formed with the case 50.

A guide pipe 60, arranged concentrically with respect to the rod-shaped antenna 10 within the case 50 including the projecting portion 51 is provided for preventing contact of the radio telephone interior with other components and other such unwanted occurrences when the rod-shaped antenna 10 is retracted within the case 50. The helical coil 21 is wound about the exterior of the top end of the guide pipe 60 situated within the projecting portion 51. The basal end 21*a* thereof is connected to a power supply portion 41 on a circuit board 40 installed within the case 50, and the distal end 21*b* thereof constitutes a free end. When the helical coil 21 is wound around the exterior of the top end of the guide pipe 60, the helical coil may be made to firmly contact the guide pipe 60, as shown in the drawing, or a gap may be left between the helical coil 21 and the guide pipe 60.

A metal fastener 16 for retaining the rod-shaped antenna 10 is securely engaged at the basal end of a rod-shaped conductor 11 covered with an insulating tube 14 that constitutes the principal element of the rod-shaped antenna 10, in such a way as to give electrical continuity with the conductor 11. A stopper 18 is integrally formed with the fastener 16 at the end of the fastener 16.

At the distal end of the conductor 11 there are integrally formed, by means of insert molding, a low-mass insulating grip 13 for retracting and extending the rod-shaped antenna 10 with respect to the case 50 and an insulating connecting member 12 for connecting the grip 13 to the conductor 11, the connecting member 12 being formed in such a way that the bottom portion 12*a* thereof connects with the conductor 11. The length of the bottom portion 12*a* of the connecting member 12 is set to such a length that when the rod-shaped antenna 10 is retracted within the case 50, the bottom portion 12*a* of the connecting member 12 passes through the helical coil 12 over the entire length thereof, severing electrical coupling between the rod-shaped antenna 10 and the helical antenna 20.

The top portion 52 of the projecting portion 51 is provided with a metal retaining member 15 connected with the projecting portion 51 by means of a screw, etc. The metal retaining member 15 can be an all-metallic product fabricated entirely of metal, or one fabricated from a mixture of metal with a non-metal(s). The connecting member 12, the fastener 16, and the conductor 11 are concentrically formed, with the outside diameters of the top portion 12*b* of the connecting member 12 and the fastener 16 having the same diameter. In contrast, the outside diameter of the insulating tube 14 covering the conductor 11 and the outside diameter of the bottom portion 12*a* of the connecting member 12 are narrower. The inside of the metal retaining member 15 is provided with a continuity piece 19 integrally formed with the retaining member 15 and having elasticity. Thus, the fastener 16 is slidable within the metal retaining member 15, and the insulating tube 14 and bottom portion 12*a* of the connecting member 12 are insertable with respect to the metal retaining member 15.

Thus, when the rod-shaped antenna 10 is extended from the case 50, the rod-shaped antenna 10 is stopped by the stopper 18 and a portion of the fastener 16 mates with the metal retaining member 15 so that, with the rod-shaped antenna 10 in the extended state, the fastener 16 is retained uprightly by the metal retaining member 15. At this time, the distal end 21*b* of the helical coil 21 and the fastener 16, i.e., the basal end of the rod-shaped antenna 10, are electrically coupled via the electrostatic coupling portion 30 having capacitive reactance that cancels out the inductive reactance of the rod-shaped antenna 10. This electrostatic coupling portion 30 is formed by means of a mechanical structure so as to be positioned leaving a prescribed gap between the distal end 21*b* of the helical coil 21 and the basal end of the rod-shaped antenna 10. of course, electrical coupling between the rod-shaped antenna 10 and the helical antenna 20 could be provided using a capacitor, an electrical component, rather than a mechanical structure.

On the other hand, when the rod-shaped antenna 10 is retracted into the case 50 until the grip 13 abuts the metal retaining member 15, the bottom portion 12*a* of the connecting member 12 mates with and is retained by the metal retaining member 15, whereby the rod-shaped antenna 10 is not readily extended to the outside by vibration, etc.

The operation of an antenna for a radio telephone in accordance with the present invention is described below. First, a description of operation with the rod-shaped antenna 10 extended upright from the case 50 will be provided referring to FIG. 1.

The conductor 11 of the rod-shaped antenna 10 has inductive reactance with impedance characteristic of $Z1=R1+jX$ at electrical length approaching $3\lambda/8$, where $\lambda$ is the wavelength of the service frequency. The helical antenna 20 is an antenna of shorter physical length than the conductor 11, with electrical length of $\lambda/4$ and impedance characteristic of $Z2=R2\pm j0$.

With the rod-shaped antenna 10 pulled out and extended, electrostatic capacitance is created in the electrostatic coupling portion 30, with the metal retaining member 15 corresponding to the basal end of the rod-shaped antenna 10 and the distal end of the helical coil 21 as electrodes. Where the capacitive reactance $-jX$ of the electrostatic coupling portion 30 is set equivalent to the inductive reactance $+jX$ of the rod-shaped antenna 10, the inductive reactance $+jX$ of the rod-shaped antenna 10 will be cancelled out by the capacitive reactance $-jX$ of the electrostatic coupling portion 30 so that the rod-shaped antenna 10 and helical antenna 20 are electrostatically coupled. In this way, the inductive reactance $+jX$ of the rod-shaped antenna 10 is cancelled out by the capacitive reactance $-jX$ of the electrostatic coupling portion 30, eliminating any irrationality in terms of antenna engineering, in stark contrast to the antenna of Conventional Art Example 3, which has the problem of being impossible to realize in terms of antenna engineering.

When power is supplied from the power supply point 41 of the radio telephone to the basal end 21*a* of the helical antenna 20, the helical antenna 20 and the rod-shaped antenna 10 are electrostatically coupled by the electrostatic coupling portion 30 so that both are excited simultaneously. Accordingly, since the helical antenna 20 of electrical length of $\lambda/4$ and the rod-shaped antenna 10 of electrical length of $3\lambda/8$ resonate and co-operate, the emission plane thereof is substantially close to the horizontal direction, affording improved horizontal direction gain and thus improved sensitivity in actual use.

In contrast to the inefficient structure of the antenna of Conventional Art Example 1, in which only the rod-shaped antenna 70 of electrical length of $\lambda/4$ operates while the helical antenna 80 does not operate, the proposed antenna has good efficiency since the rod-shaped-shaped antenna 10 and the helical antenna 20 operate integrally. Further, since the electrical length of the rod-shaped antenna is $3\lambda/8$, it is similar to a grounded antenna, reducing the effects of the human body.

Further, the impedance characteristic is determined by the helical antenna 20 connected to the power supply portion 41, and, given that the helical antenna 20 has electrical length of $\lambda/4$, is nominally 50Ω, so the antenna itself has suitable impedance characteristics, obviating the need to provide separate means for impedance matching.

Further, the helical coil 21 is arranged within a projecting portion 51 provided on the top portion of the case 50, the basal end 21*a* thereof being connected a short distance from the power supply portion 41 of the circuit board 40 provided within the case 50, and the distal end 21*b* constituting a free end electrically coupled with the basal end of the rod-shaped antenna 10 via the electrostatic coupling portion 30, thus making possible a structure wherein the distance between the power supply portion 41 and the metal retaining member 15 for retaining the basal end of the rod-shaped antenna provided on the top portion of the projecting portion 51 is greater than in the antennas of Conventional Art Examples 1 and 2, so that the free electrostatic capacitance created between the two is of a size that can be ignored in terms of antenna engineering. Thus, gain and sensitivity can be improved without hindering impedance matching.

In the antenna for a radio telephone according to the present invention, the resonance frequency of the rod-shaped antenna 10, determined by the inductive reactance $+jX$ of the rod-shaped antenna 10 and the capacitive reactance $-jx$ of the electrostatic coupling portion 30, and the resonance frequency of the helical antenna 20 can be made slightly different from each other within the service frequency band to produce a multiple tuning antenna. Since the resonance frequency of the rod-shaped antenna 10 is dependent upon the capacitive reactance $-jX$ of the electrostatic coupling portion 30, the two resonance frequencies can readily be made to differ slightly by adjusting the gap distance of the electrostatic coupling portion 30 in order to change the size of the capacitive reactance $-jX$. Accordingly, a multiple tuning antenna can be produced easily, and an efficient antenna that is nevertheless compact and has wide bandwidth characteristics can be obtained.

Figure 3:
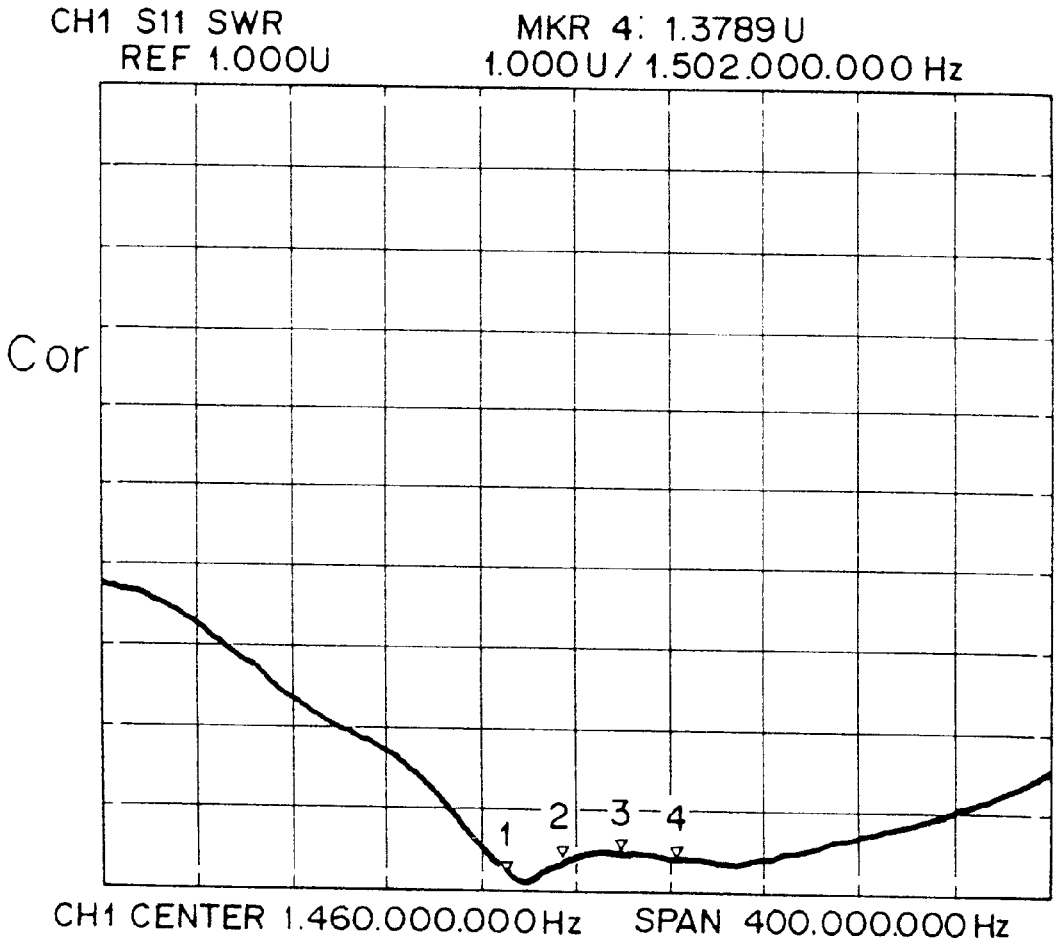
FIG. 3 is a VSWR characteristic diagram for a radio device antenna according to the present invention as employed in a 1.5 GHz portable radio device, with the rod-shaped antenna extended from the case.
Figure 4:
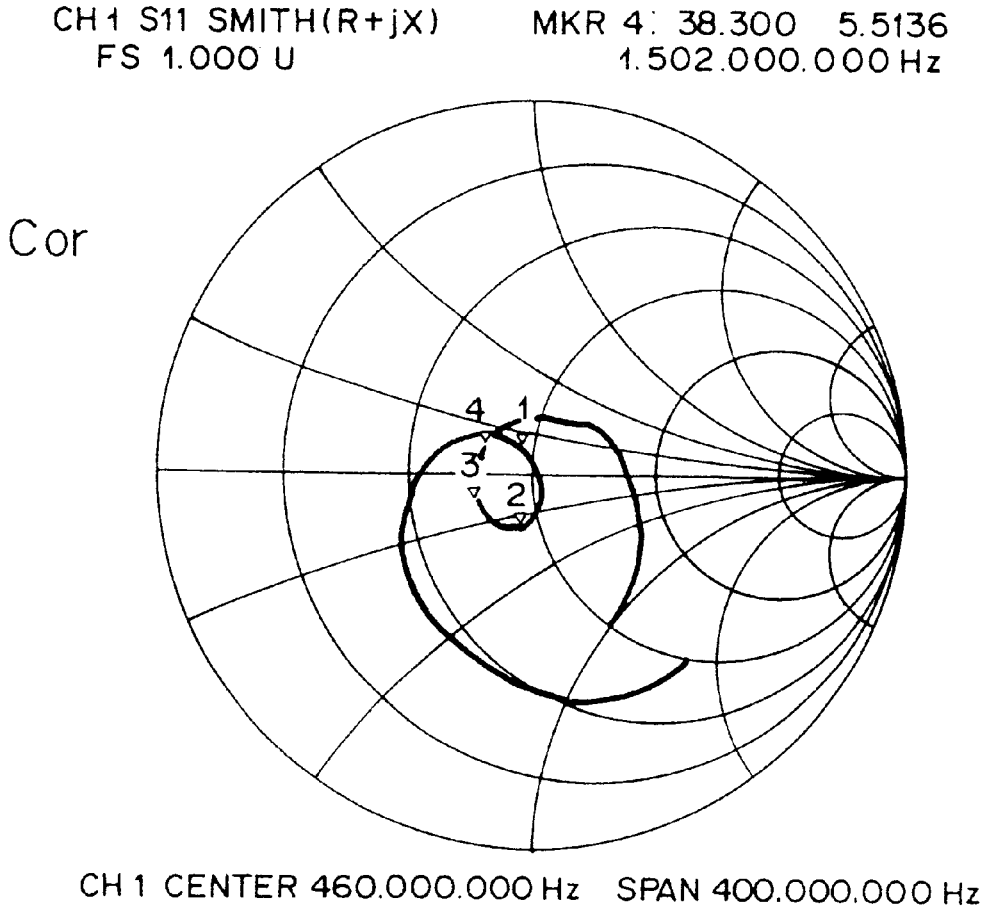
FIG. 4 is a Smith chart for a radio device antenna according to the present invention as employed in a 1.5 GHz portable radio device, with the rod-shaped antenna extended from the case.

FIGS. 3 and 4 diagram results confirming the functioning of a radio device antenna according to the present invention in an application in a 1.5 GHz portable radio device. FIG. 3 is a VSWR characteristics chart of a state wherein the rod-shaped antenna 10 is extended from the case 50 and the rod-shaped antenna 10 and helical antenna 20 are operated integrally. FIG. 4 is a Smith chart of the same state. As will be apparent from FIGS. 3 and 4, in a state wherein the rod-shaped antenna 10 is extended from the case 50, transmission and reception characteristics marked by good sensitivity over a wide band are achieved.

Further, in contrast to the antennas of Conventional Art Examples 1 and 2, wherein a large-mass helical antenna 20 is provided at the distal end of a rod-shaped antenna 10, in the antenna according to the present invention, the helical coil 21 constituting the principal element of the helical antenna 20 is situated within the projecting portion 51 provided on the top portion of the case 50, providing only a small-mass grip 13 to the distal end of the rod-shaped antenna 10. Thus, there is negligible characteristic vibration with respect to external pressure, and the amplitude thereof is small and rapidly attenuated, thus affording a good antenna that does not experience mechanical or electrical noise and eliminating the risk that the retaining power of the retaining member 15 will deteriorate. While the connecting member 72 provided to the top portion of the rod-shaped antenna 70 in Conventional Art Example 1 has problems in terms of flexural strength, in the antenna according to the present invention, a small-mass grip 13 and a connecting member 12 are integrally formed at the distal end of the rod-shaped antenna by means of insert molding, and thus breakage and damage due to flexing of the connecting member 12 are avoided.

Operation in a state wherein the rod-shaped antenna 10 is retracted within the case 50 will now be described referring to FIG. 2.

In a state wherein the rod-shaped antenna 10 is retracted within the case 50, the connecting member 12 provided on the distal end of the rod-shaped antenna 10 passes through the interior of the helical coil 21, with the distal end of the bottom portion 12*a* thereof reaching the bottom portion of the helical antenna 20. The length of the bottom portion 12*a* of the connecting member 12 is set to such a length that it passes through the helical coil 21 over the entire length thereof, severing electrical coupling between the rod-shaped antenna 10 and the helical antenna 20, whereby the rod-shaped antenna 10 becomes isolated without electrical coupling with the helical antenna 20. Accordingly, in the retracted state, unwanted radio waves are not emitted by the rod-shaped antenna 10 retracted within the case 50, and only the helical antenna 20 arranged within the projecting portion 51 operates, affording a standby condition free of difficulties within the radio telephone.

While not shown in the VSWR characteristics diagram and Smith chart for the state wherein the rod-shaped antenna 10 is retracted within the case 50 and only the helical antenna 20 is operated, the electrical length of the helical antenna 20 is $\lambda/4$, and even in the state wherein the rod-shaped antenna 10 is retracted within the case 50, the sensitivity required for receiving calls or, depending on electric field strength, both making and receiving calls, is of course achieved.

Further, while the electrical length of the antenna of Conventional Art Example 2 is $\lambda/2$, the electrical length of the rod-shaped antenna 10 is shorter ($3\lambda/8$), allowing it to be retracted leaving a margin within the case 50.

That is, according to the antenna for a radio telephone which pertains to the present invention, there is provided a good antenna that does not create difficulties within the radio telephone, while also being retractable leaving a margin.

Further, by providing the projecting portion 51 integrally on the top face of the case 50, even in the event of the radio telephone being accidentally dropped, the impact load will be dispersed by the basal end 53 of the projecting portion 51, affording an antenna having improved strength in terms of accidental bending, snapping, etc.

Further, in the event that it becomes necessary to change and replace [elements] due to accidental droppage, since the helical antenna 20 is situated within the projecting portion 51, it will not break, and thus in virtually all cases only the rod-shaped antenna 10 will break. In such an event, it is sufficient simply to remove the metal retaining member 15 from the case 50 and to replace only the rod-shaped antenna 10, so the cost for repair is lower than with the antennas of Conventional Art Examples 1 and 2. The antenna is also superior to the Conventional Art Examples in terms of maintenance.

According to the antenna for a radio telephone pertaining to the present invention described herein, the drawbacks of the antennas of Conventional Art Examples in terms of use as antennas in the increasingly more compact and light-weight portable radio telephones seen recently may be overcome, and a more compact size and lighter weight may be realized. For example, while total length thereof would be 91–95 mm according to Conventional Art Example 1 and 125–130 mm according to Conventional Art Example 2, it would be 105–110 mm with the antenna of the present invention, and the weight would be equal to or lighter than Conventional Art Example 1 and lighter than Conventional Art Example 2.

Thus, according to the antenna pertaining to the present invention, there are afforded numerous advantages not seen in the antennas of Conventional Art Examples, such as improved gain and sensitivity when extended, despite smaller size and lighter weight, wide band characteristics having frequency bandwidth about 1.4 times that in the Conventional Art Examples, superiority close to grounded antennas that are not susceptible to effects of the human body, structural strength sufficient to withstand external vibration, etc., no emission of unwanted radio waves within the radio telephone when retracted therein, and reduced maintenance costs associated with misuse.

Figure 5:
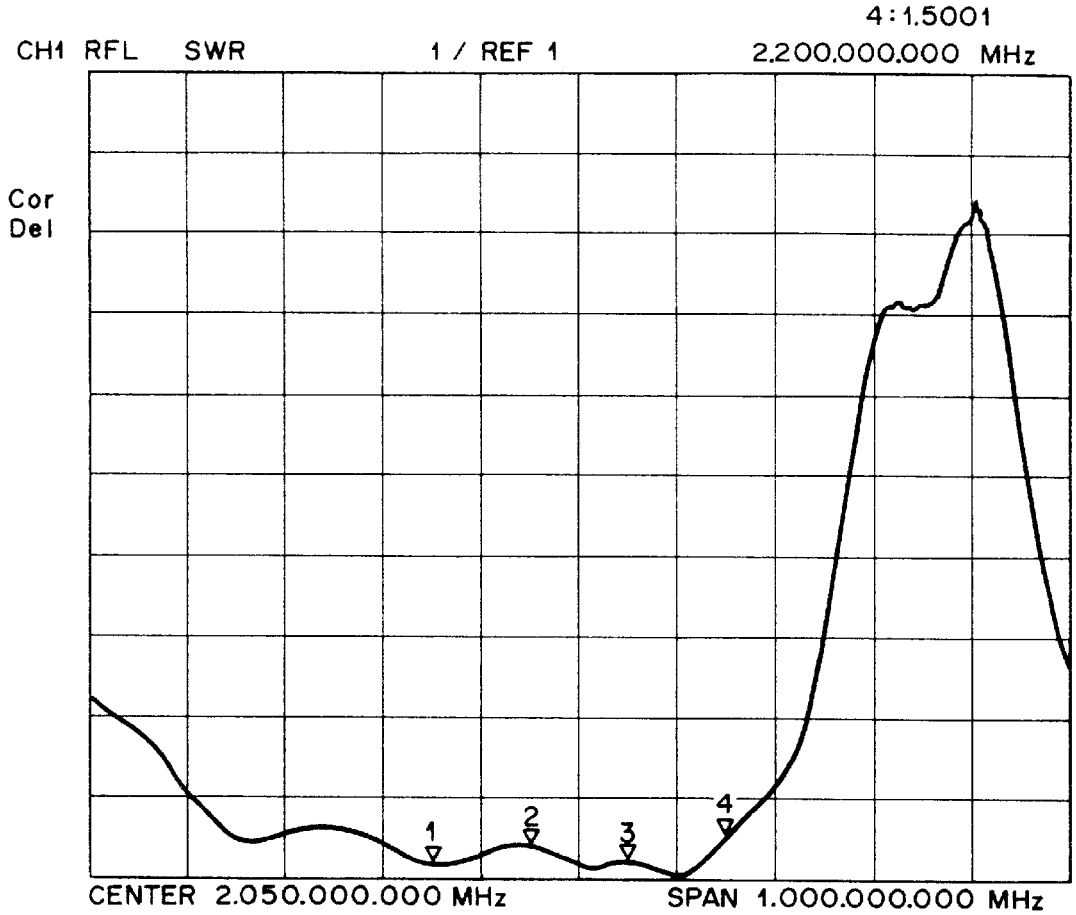
FIG. 5 is a VSWR characteristic diagram for a radio device antenna according to the present invention as employed in a W-CDMA type radio device antenna application, with the rod-shaped antenna extended from the case.
Figure 6A:
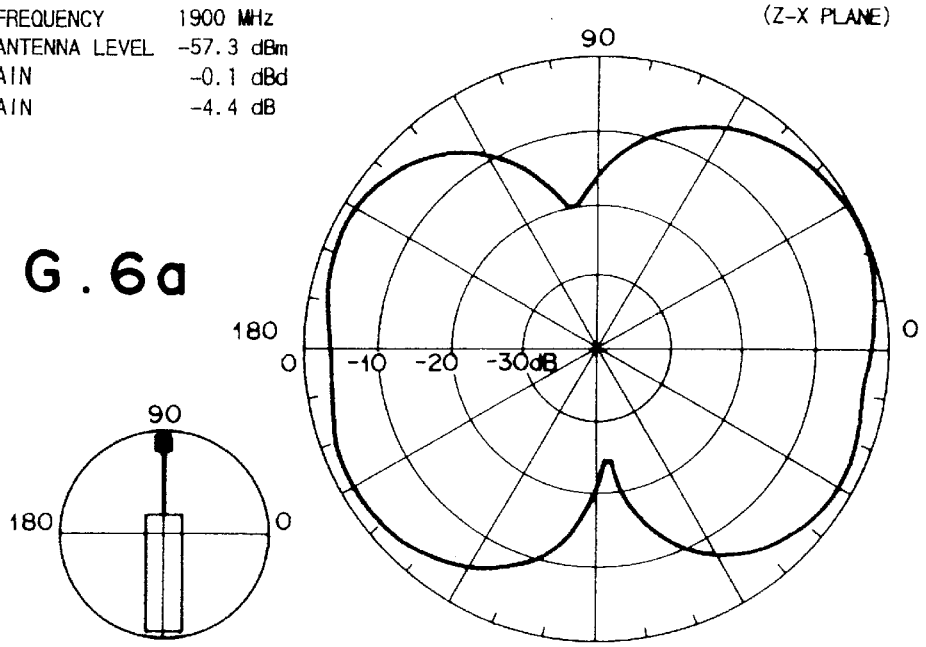
FIGS. 6*a* and 6*b;* 7*a* and 7*b;* and 8*a* and 8*b* are antenna directional characteristic diagrams for a radio device antenna according to the present invention as employed in a W-CDMA type radio device antenna application, with the rod-shaped antenna extended from the case, with FIGS. 6*a* and 6*b* showing the front to back pattern in the vertical plane, FIGS. 7*a* and 7*b* showing the left to right pattern in the vertical plane, and FIGS. 8*a* and 8*b* showing the pattern in the horizontal plane, with, in each figure, the pattern at (a) being for a measured frequency of 1.9 GHz and the pattern at (b) being for a measured frequency of 2.2 GHz.
Figure 6B:
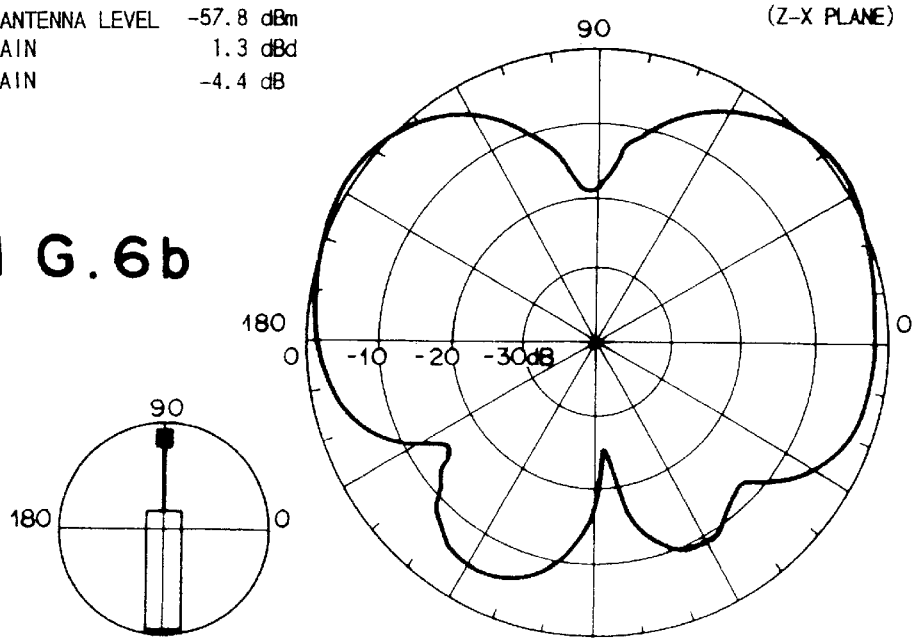
Figure 7A:
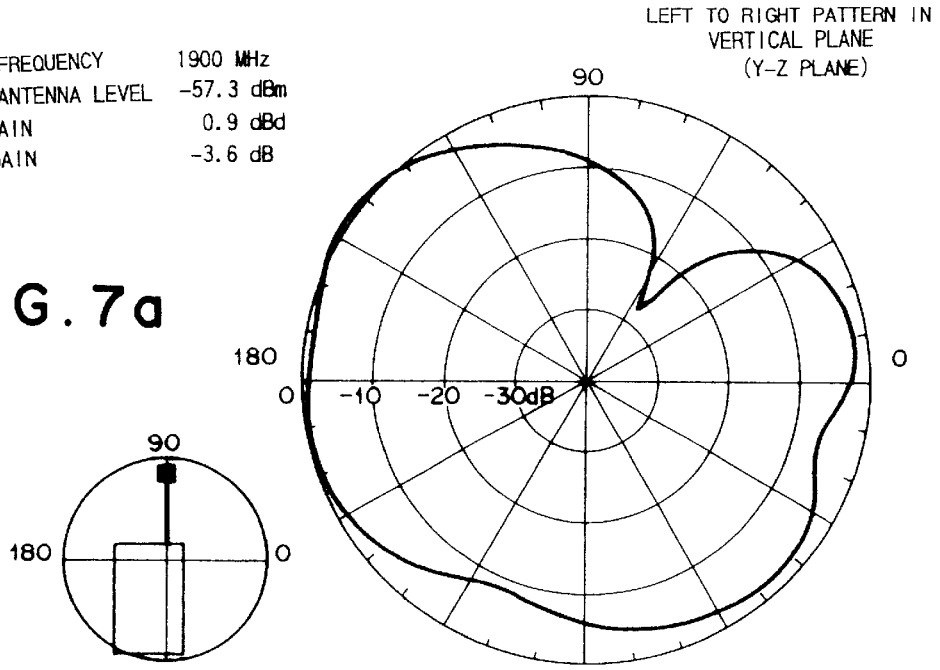
Figure 7B:
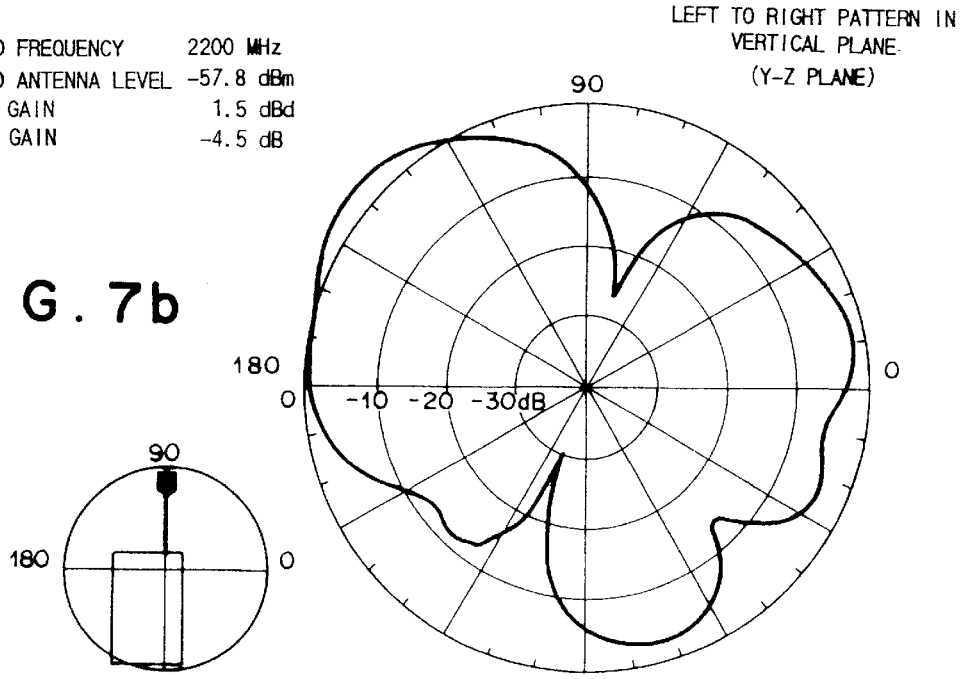
Figure 8A:
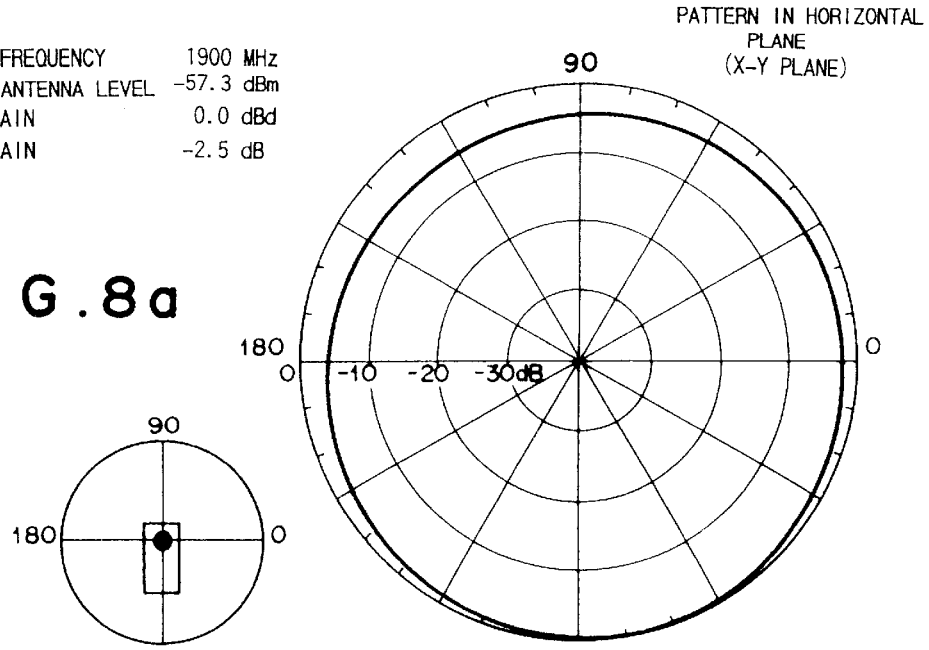
Figure 8B:
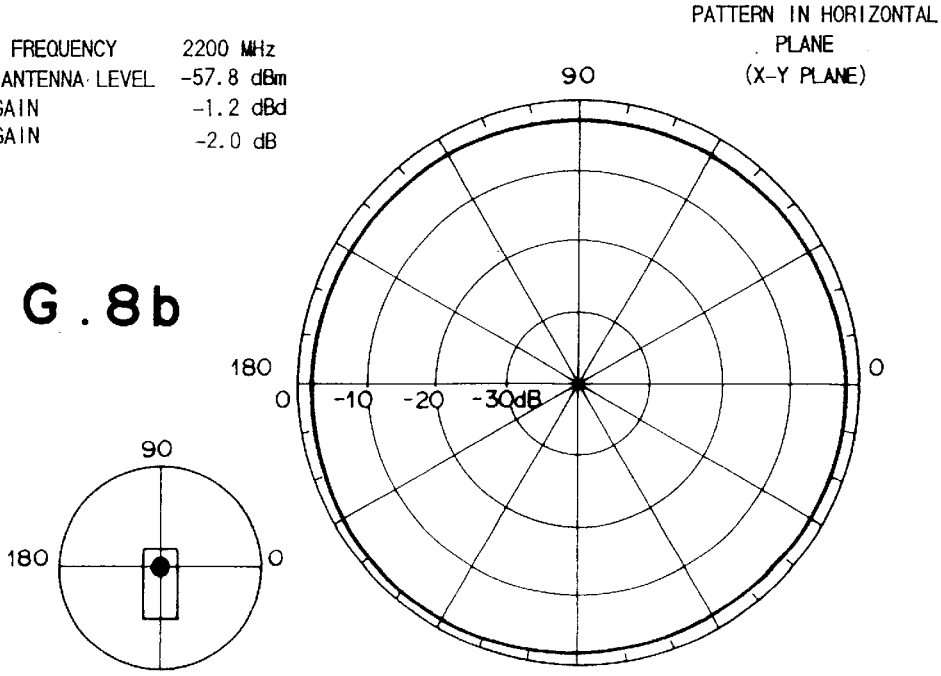

Next, for an embodiment wherein a radio device antenna according to the present invention is employed in a W-CDMA (wide-code division multiple access) radio device antenna operating in frequency bands of 1.9 to 2.2 GHz, the VSWR characteristics with the rod-shaped antenna extended from the case are shown in diagramatic form in FIG. 5, and the antenna directionality characteristics are shown in diagramatic form in FIGS. 6–8 with the antenna in the same condition. Here, FIG. 6 represents the front to back pattern in the vertical plane (Z-X PLANE), FIG. 7 the left to right pattern in the vertical plane (Y-Z PLANE), and FIG. 8 the pattern in the horizontal plane (X-Y PLANE), with "a" in each figure representing the pattern at a measured frequency of 1.9 GHz and "b" in each figure the pattern at a measured frequency of 2.2 GHz. The basic characteristics shown in FIGS. 6–8 are summarized in Table 1.

TABLE 1

| W-CDMA | Supported |
|---|---|
| Frequencies used | 1.9 GHz to 2.2 GHz |
| Center frequency | 2.05 GHz |
| VSWR | Extended: ≦1.5 |
| | (Bandwidth ≧ 550 MHz when VSWR ≦ 2.0) |
| | Retracted: ≦3.5 |
| Gain | Extended: |
| | In horizontal plane: |
| | Max −1.5 dBd or better |
| | Averaqe −2.5 dBd or better |
| | Left to right in vertical plane: |
| | Max +1.0 dBd or better |
| | Front to back in vertical plane: |
| | Max 0.0 dBd or better |
| Antenna type | Extended: |
| | $\lambda/4$ helical + $3/8\lambda$ whip electrostatically coupled |
| | Retracted: $\lambda/4$ helical |

As can be seen from FIGS. 5–8 and Table 1, with the rod-shaped antenna extended from the case, the VSWR is 1.5 or lower throughout the band spectrum used, the gain reaches a maximum value of −1.5 dBd or greater in the horizontal plane, a maximum value of +1.0 dBd or greater left to right in the vertical plane, and a maximum value front to back in the vertical plane of 0.0 dBd or greater, throughout the entire band spectrum used, with the direction of maximum radiation being oriented nearly horizontally in all directions. Thus, by applying the present invention to W-CDMA radio device antennas, extremely efficient antennas can be configured which exhibit high gain and wide frequency characteristics.

The aspect of the embodiment described in the foregoing is one example of a radio device antenna based on the present invention, and can be configured in modified forms within such range that the essential concepts inherent therein are not lost.

For example, the foregoing descriptions pertain to the application of the present invention in radio devices used in portable telephone instruments, but the present invention is not limited to these applications, and antennas can be configured for radio devices capable of being accommodated inside notebook computers, for example.

In the foregoing descriptions, moreover, the rod-shaped antenna is described as a type of antenna that can be accommodated inside a case, but, in terms of the performance of the rod-shaped antenna when in use, the rod-shaped antenna does not necessarily need to be limited to a type capable of accommodation inside a case.

Figure 9:
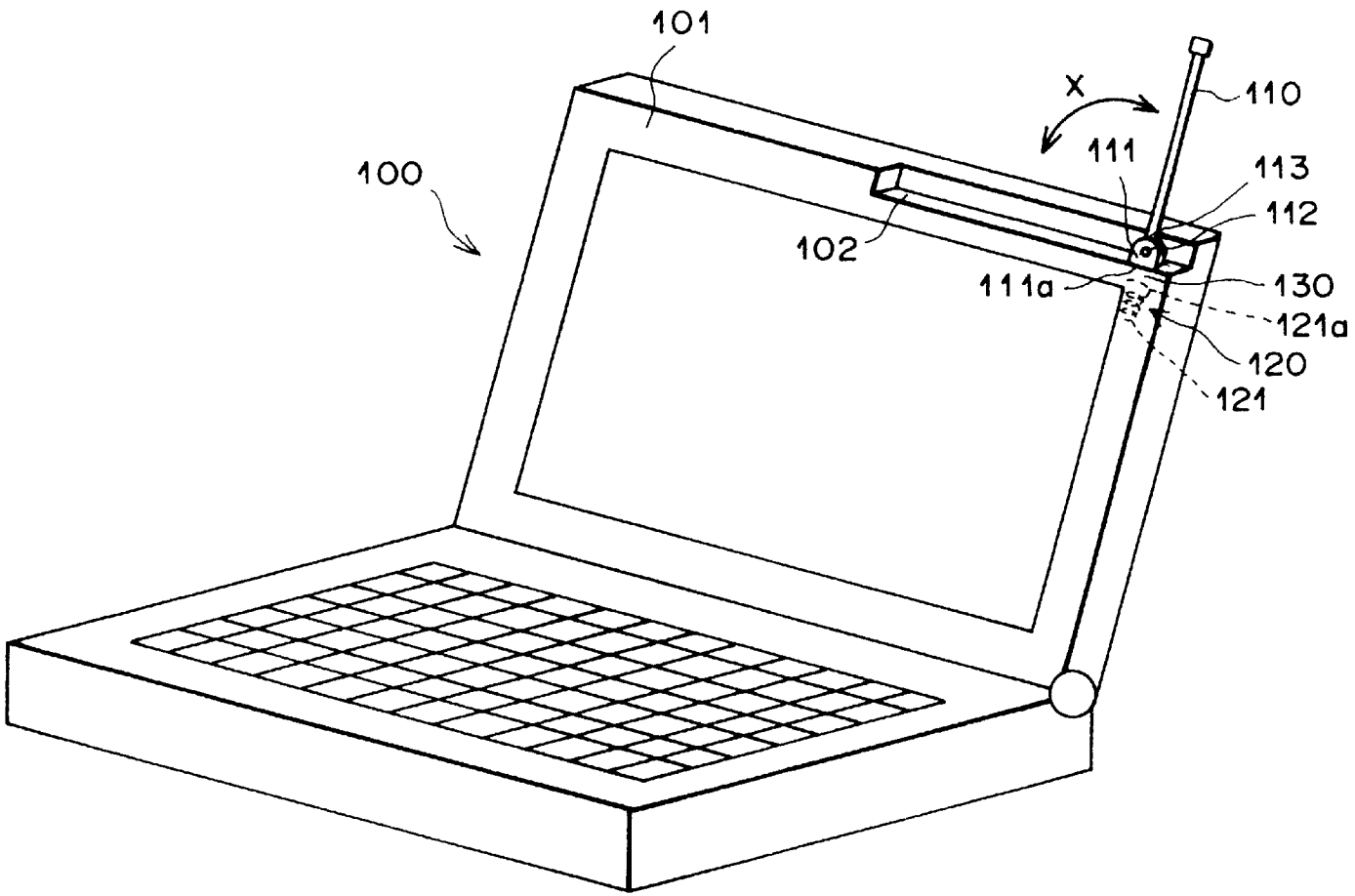
FIG. 9 is a diagram of an example application of a radio device antenna according to the present invention in a notebook computer, showing the rod-shaped antenna in an erect condition relative to the upper edge of the display panel.
Figure 10:
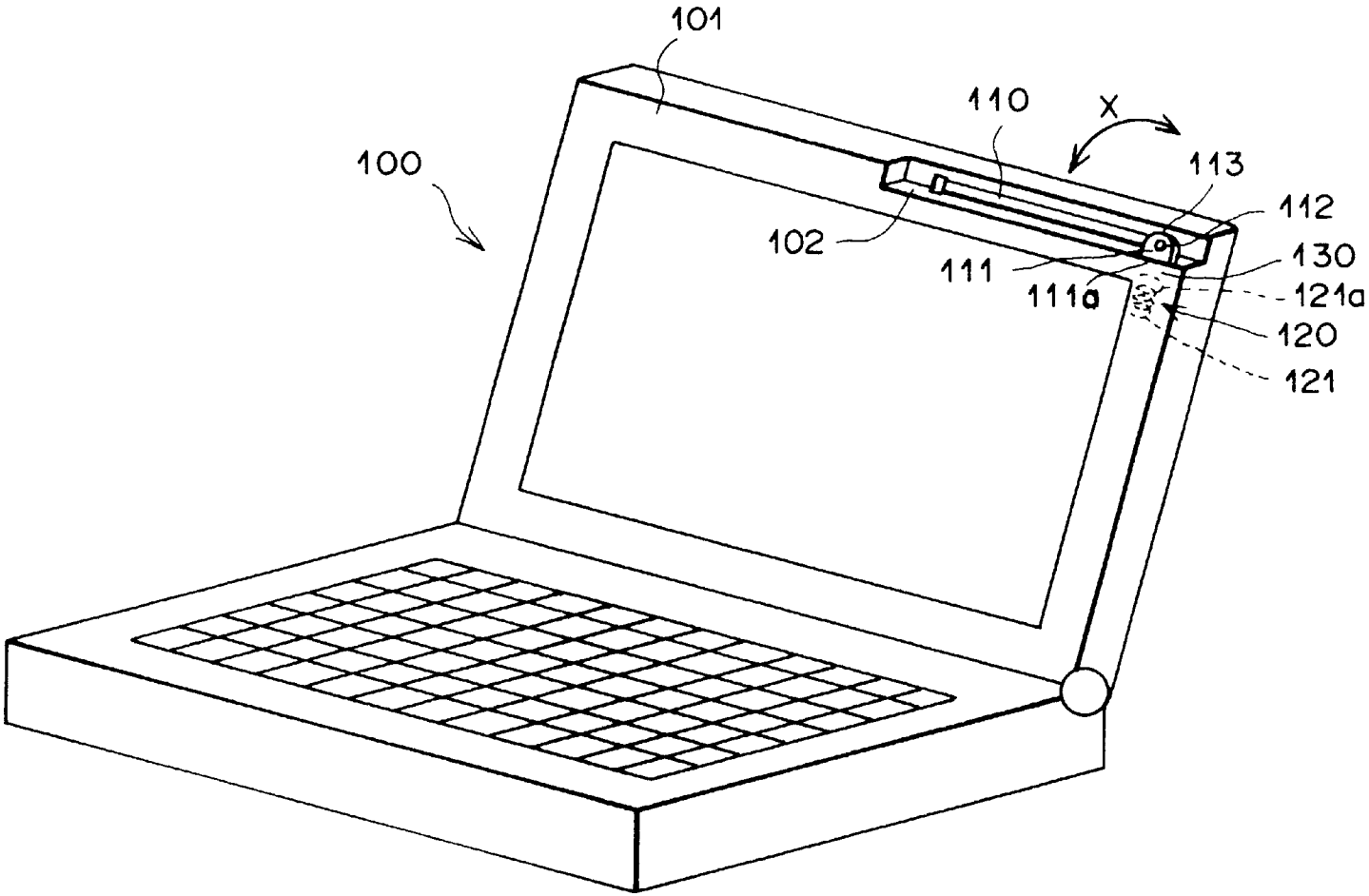
FIG. 10 is a diagram of an example application of a radio device antenna according to the present invention in a notebook computer, showing the rod-shaped antenna folded down into a concavity.
Figure 11A:
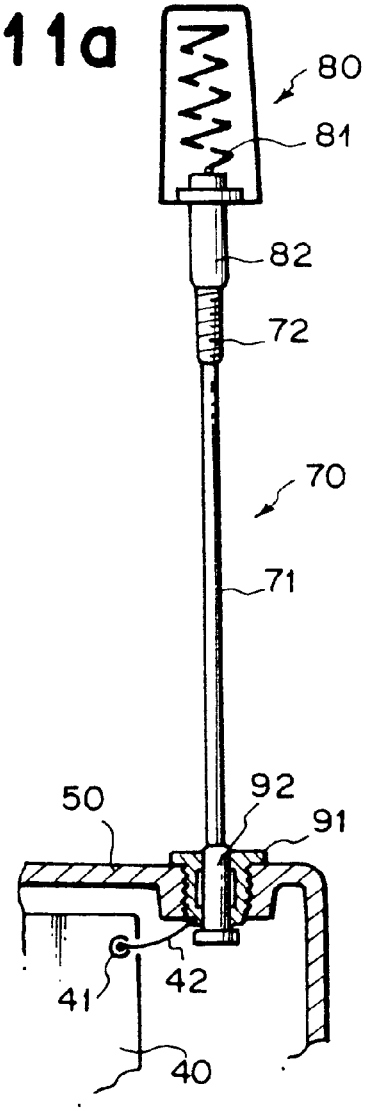
FIGS. 11*a* and 11*b* each are a sectional view of a radio telephone equipped with the antenna of Conventional Art Example 1, (a) being a diagram showing the rod-shaped antenna extended from the case and (b) being a diagram showing the rod-shaped antenna retracted within the case.
Figure 11B:
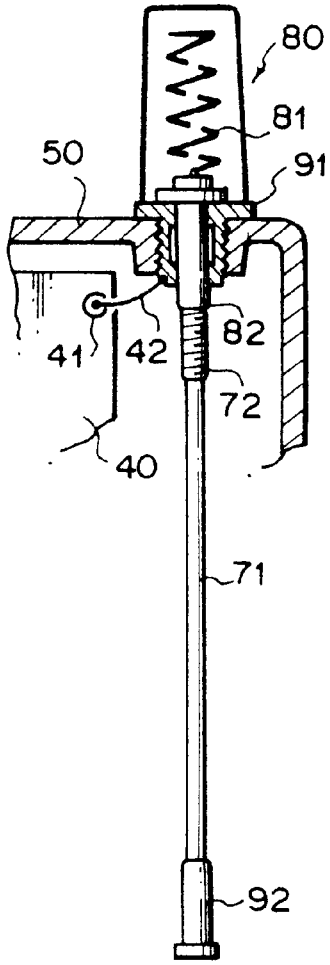
Figure 12A:
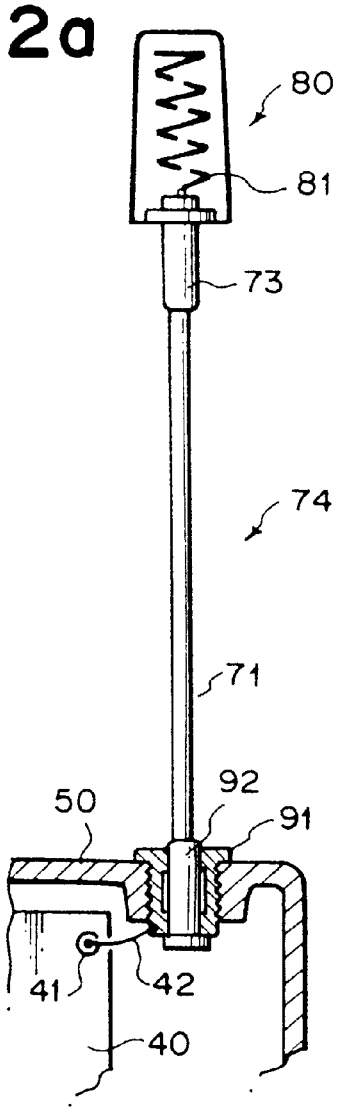
FIGS. 12*a* and 12*b* each are a sectional view of a radio telephone equipped with the antenna of Conventional Art Example 2, (a) being a diagram showing the rod-shaped antenna extended from the case and (b) being a diagram showing the rod-shaped antenna retracted within the case.
Figure 12B:
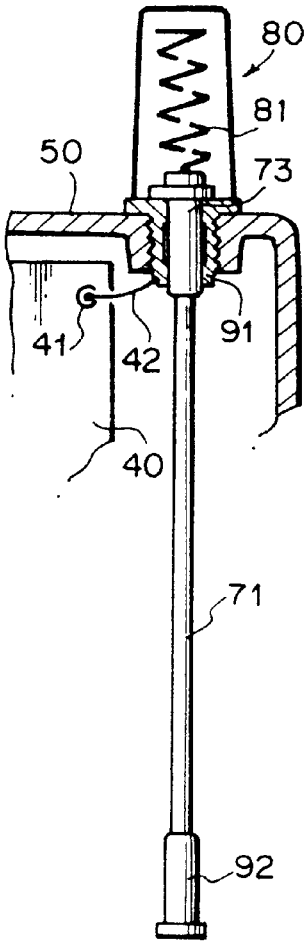

As shown in FIGS. 9 and 10, for example, a concavity 102 is provided along the upper edge of the case of the display panel 101 for a notebook computer 100, a metal guide 111 is installed as a metal holding member for holding the rod-shaped antenna 110, and a hinge 112 provided in this guide 111 and the basal end 113 of the rod-shaped antenna 110 are pivotally supported so that they can turn freely, so that the rod-shaped antenna can be raised and lowered in the X-direction indicated in the drawing, supported at the hinge 112. Thus, when the rod-shaped antenna is being used, the rod-shaped antenna 110 can stand erect, relative to the upper edge of the display panel 101, as diagrammed in FIG. 9, whereas when not being used, the rod-shaped antenna 110 can be folded down flat, relative to the upper edge of the display panel 101, and housed, as shown in FIG. 10. In other words, the rod-shaped antenna 110 is in the non-deployed position when it is laid down in the concavity 102, when not. in use, and is in the deployed position when raised out of the concavity 102 and stood up more or less vertically at the upper edge of the case of the display panel 101 when in use.

Also, a helical coil 121 constituting the main body of a helical antenna 120 is deployed inside the display panel 101 opposite the lower edge 111*a* of the guide 111, so that when the rod-shaped antenna 110 is made to stand up, that helical coil 121 becomes concentric with the rod-shaped antenna 110.

The rod-shaped antenna 110 is established with an electrical length of roughly $3\lambda/8$, and exhibits inductive reactance. The helical antenna 120, on the other hand, is established with an electrical length of $\lambda/4$ . By deploying the basal end 113 of the rod-shaped antenna 110 and the distal end 121*a* of the helical antenna 121 (which is to say the distal end of the helical coil 120) so that there is a gap therebetween, an electrical coupling is formed with the electrostatic coupling 130. Also, by making the capacitive reactance $-jX$ of this electrostatic coupling 130 so that it matches the inductive reactance $+jX$ of the rod-shaped antenna 110, the rod-shaped antenna 110, when it is used in the erect position, will function in the same way as the rod-shaped antenna 10 described earlier when it is extended from the case 50 and made to stand up. More specifically, when the rod-shaped antenna 110 is used in the erect position, the rod-shaped antenna 110 having an electrical length of roughly $3\lambda/8$ and the helical antenna 120 having an electrical length of $\lambda/4$ will work cooperatively, functioning integrally almost as an ungrounded antenna, and operating as an efficient antenna with the electromagnetic radiation characteristics oriented very slightly below the horizontal plane even in the vertical plane.

Also, by folding the rod-shaped antenna 110 over into the concavity 102 (non-deployed position) when the notebook computer 100 is being carried about, the rod-shaped antenna will not get in the way, and there will be no danger of it getting bent and thus damaged or destroyed.

The foregoing aspect is one example of an antenna for a radio telephone according to the present invention, modifications thereof being possible without departing from the spirit thereof.

What is claimed is:

1. An antenna for a radio telephone, comprising:

a helical antenna having an electrical length of about $\lambda/4$, wherein $\lambda$ is a wavelength of a service frequency, and having a basal end thereof, which is arranged on a wall of a case of the radio telephone, connected to a power supply component of the radio telephone; and a rod antenna extendable and retractable with respect to the case of the radio telephone through a hollow central portion of the helical antenna, with an electrical length of about $3\lambda/8$ and having inductive reactance;

wherein a basal end of the rod antenna and a distal end of the helical antenna are electrically coupled in series by means of an electrostatic coupling portion having a capacitive reactance that cancels out the inductive reactance when the rod antenna is extended from the radio telephone case, and wherein a gap is formed between the basal end of said rod antenna and the distal end of said helical antenna when said rod antenna is being used, said gap being defined by a longitudinal space between the basal end of said rod antenna and the distal end of said helical antenna.

2. An antenna for a radio telephone as set forth in claim 1, characterized in that an insulating grip for extending and retracting the rod antenna with respect to the case, and an insulating connecting member for connecting the grip and the rod antenna are integrally formed through insert molding at a distal end of the rod antenna.

3. An antenna for a radio telephone as set forth in claim 2, characterized in that the length of the connecting member is set to a length such that when the rod antenna is retracted within the case, the connecting member passes through the helical antenna over the entire length thereof, severing electrical coupling between the helical antenna and the rod antenna.

4. An antenna for a radio telephone as set forth in claim 1, characterized by being provided with a projecting portion situated over a portion of the top face of the case of the radio telephone; the top portion of the projecting portion being provided with a retaining portion for retaining the bottom portion of the rod antenna when the rod antenna is extended from the case; and the helical antenna being arranged concentrically with respect to the rod antenna in the space within the projecting portion with a gap between the helical antenna and the basal end of the rod antenna.

5. A radio device antenna comprising:

a rod antenna having an electrical length of roughly $3\lambda/8$, wherein $\lambda$ is a wavelength of a service frequency, said rod antenna exhibiting an inductive reactance; and a helical antenna having an electrical length of $\lambda/4$, said helical antenna being deployed on a wall of a case of a radio device and having a basal end thereof being connected to a power supply of the radio device, wherein said helical antenna and said rod antenna are electrically coupled in series in an electrostatic coupling portion when said rod antenna is being used, said electrostatic coupling having a capacitive reactance that cancels out said inductive reactance, and wherein a gap is formed between a basal end of said rod antenna and a distal end of said helical antenna when said rod antenna is being used, said gap being defined by a longitudinal space between the basal end of said rod antenna and the distal end of said helical antenna.

6. The radio device antenna according to claim 5, wherein said rod antenna can be freely raised and lowered between a deployed position projecting from said radio device case when in use, and a non-deployed position folded along part of said case when not in use.

7. An antenna for a radio telephone as set forth in claim 5, characterized in that the electrostatic coupling portion constitutes a mechanical structure.

8. An antenna for a radio telephone as set forth in claim 5, characterized in that the distance between a power supply portion and a metal retaining member for retaining the rod antenna is of such a size that the free electrostatic capacitance created between the two is essentially zero.

9. An antenna for a radio telephone as set forth in claim 5, characterized in that the resonance frequency of the rod antenna and the resonance frequency of the helical antenna are set so as to provide multiple tuning characteristics.

* * * * *